United States Patent [19]

Rogers et al.

[11] 4,030,546

[45] June 21, 1977

[54] SWIVEL ASSEMBLY

[75] Inventors: Jerry L. Rogers, New Orleans, La.; Chudleigh B. Cochran, Houston, Tex.

[73] Assignee: Brown Oil Tools, Inc., Houston, Tex.

[22] Filed: July 28, 1975

[21] Appl. No.: 599,628

[52] U.S. Cl. ..... 166/208; 166/177; 308/9

[51] Int. Cl.[2] ..... E21B 43/10

[58] Field of Search ..... 166/208, 285, 177; 308/9; 175/107

[56] References Cited

UNITED STATES PATENTS

| | | | |
|---|---|---|---|
| 2,609,881 | 9/1952 | Warren | 166/285 |
| 2,883,156 | 4/1959 | Davenport | 175/107 |
| 3,223,170 | 12/1965 | Mott | 166/208 |
| 3,493,273 | 2/1970 | Greenberg | 308/9 |
| 3,720,271 | 3/1973 | Kern | 175/107 |
| 3,777,819 | 12/1973 | Delano | 166/285 |
| 3,866,988 | 2/1975 | Striegler | 308/9 |
| 3,920,075 | 11/1975 | Braddick et al. | 166/208 |

*Primary Examiner*—James A. Leppink
*Attorney, Agent, or Firm*—Carlos A. Torres; E. Richard Zamecki

[57] ABSTRACT

Disclosed is a swivel assembly with multiple fluid bearings. The embodiment shown is a rotatable liner swivel assembly to be used, in conjunction with a liner hanger, cam dog assembly, and setting tool, for placing and cementing a liner in a well. Fluid-filled annular bearing chambers in the swivel assembly support the load of the liner pipe string, and permit the rotation of the liner pipe string with respect to the liner hanger during the cementing process. The bearing chambers are interconnected to equalize the fluid pressure and distribute the load uniformly over the bearing chambers.

27 Claims, 5 Drawing Figures

SWIVEL ASSEMBLY

BACKGROUND OF THE INVENTION

1. Field of the Invention

The present invention pertains to swivel devices for rotatably supporting loads. More particularly, the present invention pertains to apparatus for supporting and permitting rotation of a liner pipe string in a well during the process of cementing the liner pipe string in place.

2. Description of Prior Art

A liner is a section of casing or tubing which is suspended in a well without normally extending to the surface. Two or more such sections constitute a liner string. Cemented liners are utilized for a number of reasons: providing well control, reducing initial cost of casing, more rapid installation than of full casing strings, etc. Liners may be installed entirely within outer casing strings or partially in an open hole.

Conventionally, a liner is set and cemented by first lowering the liner supported by a liner hanger and a setting tool, which is connected to an operating string, into the well bore. The liner is hung, usually on slips, and the setting tool is released from the hanger. Cement is then pumped through the operating string into the liner, and displaced from the liner, usually through a foot valve, into the annular space between the liner and the surrounding casing or well bore. The details of such a cementing operation, as well as various tools for carrying it out, are well known in the prior art.

It has been found, especially where the liner string to be cemented is of considerable length, that the cement will more easily circulate down the liner string and up the annular region between the liner string and the well casing or bore if, during the cementing operation, the liner string is rotated. Such a rotation of the liner pipe string requires rotational motion of the liner with respect to the liner hanger, which is fixed with respect to the well casing above the liner pipe string by the hanger slips. Consequently, in such a case, the liner pipe string must be supported by the liner hanger through some sort of a rotatable coupling device. Such rotatable coupling devices with mechanical bearings are well known in the art. Typical rotating liner hangers employed in the oil and gas industry feature ball bearing assemblies to carry the load of the liner pipe string and permit rotational motion between the liner string and the hanger slips. However, mechanical bearing devices used in this manner are susceptible to undesirable unequal loading. This is particularly true where the well bore is not straight, or is not exactly vertical. Unequal loading also occurs where two or more mechanical bearing assemblies are stacked vertically in the liner hanger.

SUMMARY OF THE INVENTION

The swivel assembly of the present invention includes primarily three concentric cylindrical bodies with appropriate annular chambers between them. An outer tubular housing member cooperates with an intermediate mandrel to form two or more axially-spaced, annular bearing chambers sealed from each other by packing glands. An inner, core mandrel, sealed at both ends to the intermediate mandrel, defines, with the intermediate mandrel, a long, annular chamber that communicates with each of the bearing chambers by way of ports passing through the intermediate mandrel. The annular chamber between the core mandrel and the intermediate mandrel, the bearing chambers, and the ports through the intermediate mandrel are all filled with a bearing fluid such as oil or mercury. The intercommunication among all of these fluid-filled areas ensures that fluid pressure is equalized throughout. The fluid acts as both rotational and load-supporting bearings between the outer tubular housing member and the intermediate and core mandrels.

A swivel assembly, applied to well tools, is inserted in a well between a liner hanger and a liner pipe string to be cemented in the well. The packing glands defining the axial boundaries of the bearing chambers are axially constrained by the intermediate mandrel and by the tubular housing member so that a downward force exerted by the intermediate mandrel coupled with an upward force exerted by the tubular housing member tends to compress each bearing chamber between its respective packing glands. Therefore, with the swivel assembly suspended from the liner hanger by the tubular housing member, and the liner pipe string connected directly to the bottom of the intermediate mandrel, the weight of the liner pipe string is carried by the intermediate mandrel, the upper packing gland of each bearing chamber, the fluid in each bearing chamber, the lower packing gland of each bearing chamber, the tubular housing member, and the liner hanger in that order. The fluid in the bearing chambers thus performs the function of thrust bearings in supporting the load of the liner pipe string, and with the packing glands, which constitute rotatable seals between the intermediate mandrel and the tubular housing member, permits the liner pipe string and the intermediate mandrel to be rotated with respect to the tubular housing member and the liner hanger. The long, annular chamber between the core mandrel and the intermediate mandrel, along with the ports through the intermediate mandrel to the bearing chamber, permits fluid transfer and equalization of fluid pressure among the bearing chambers throughout the entire liner insertion and cementing processes. Based on the functions performed by the bearing fluid in the annular bearing chambers, the swivel assembly may be viewed as two assemblies: an outer portion joined to the liner hanger; and an internal, or core, portion from which the liner pipe string is suspended, and including the intermediate mandrel and the core mandrel.

With the liner pipe string in place in the well, and the liner hanger above the swivel assembly anchored to the well casing, cement may be introduced into the liner pipe string through a tube passing within the core mandrel of the swivel assembly. The tube may be selectively locked to the liner pipe string through a cam-operated dog assembly for the purpose of transferring torque from the tube to the liner pipe string. Thus, while cement is circulated down the tube in the liner pipe string and up the annular region between the liner pipe string and the well casing or well bore, the tube may be rotated by torque applied at the surface, thereby causing the cam dog assembly to lock the tube to the liner pipe string, with the result that the liner pipe string also rotates. As the liner pipe string is rotated, the intermediate mandrel of the swivel assembly is also rotated with respect to the tubular housing member, with the packing glands and the fluid of the bearing chambers performing the function of rotational bearings. Once the cement is in place, the rotation of the tube and liner pipe string is stopped, the cam dogs are released from the liner pipe string, and the tube is removed. The swivel assembly then remains fixed in the well as an extension of the liner pipe string.

BRIEF DESCRIPTION OF THE DRAWINGS

FIG. 1A shows the top of the arrangement and FIG. 1B shows the bottom of the arrangement;

DESCRIPTION OF A PREFERRED EMBODIMENT

Figure 1A:
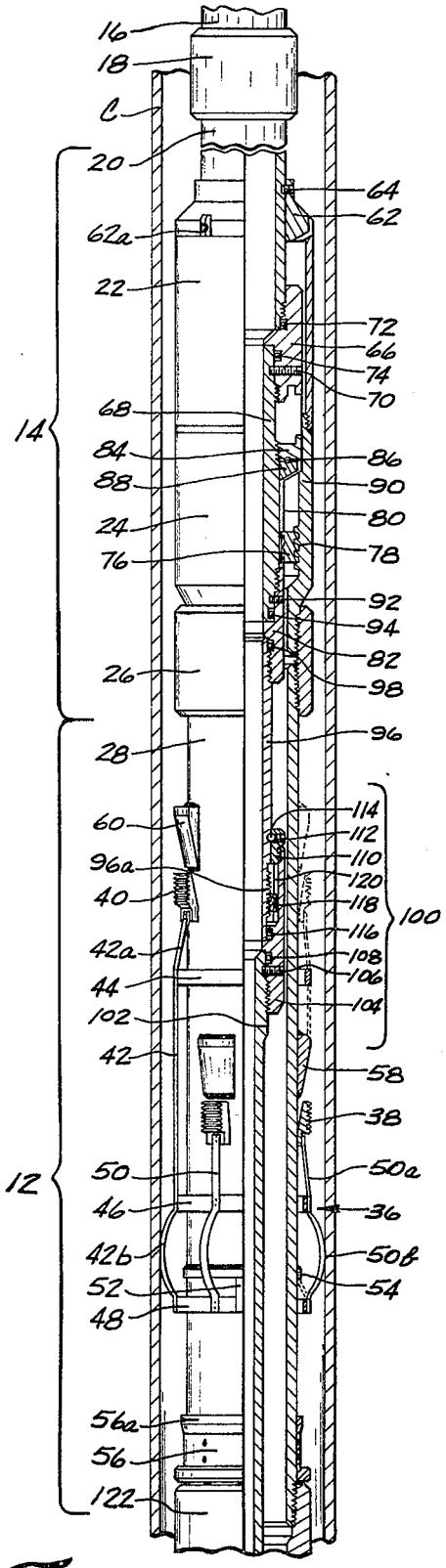
FIGS. 1A and 1B together illustrate, in partial section, the rotatable swivel assembly of the present invention positioned in a well casing with a liner hanger and a setting tool.
Figure 1B:
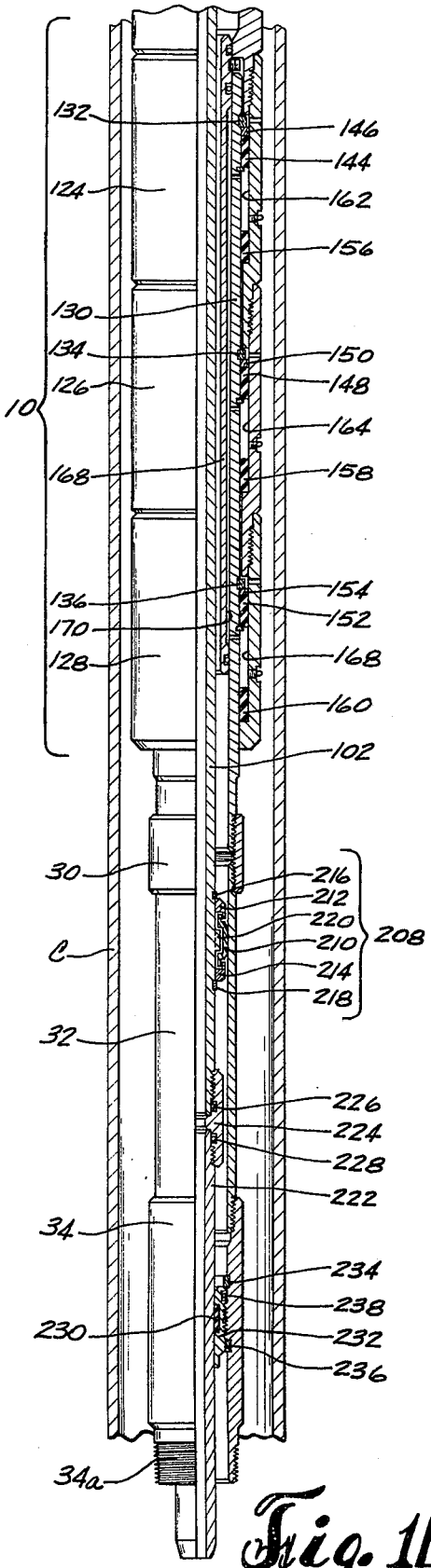

The accompanying Figs. illustrate the swivel assembly of the present invention as applied to the manipulation of equipment in a well. FIGS. 1A and 1B show a rotatable swivel assembly at 10 being run into a well casing C, suspended below a liner hanger at 12 and a setting tool at 14. A running-in, or operating, string 16, extending down from the surface (not shown), supports the entire combination of elements, and is used to apply torque as described hereinafter. A coupling 18 and a connector tube 20 join the setting tool at 14 to the operating string 16. An upper coupling sleeve 22 and a lower coupling sleeve 24 form a tubular housing for the setting tool at 14. The lower coupling sleeve 24 is joined by a coupling 26 to a liner hanger mandrel 28, which in turn supports the swivel assembly at 10. Suspended by a coupling 30 below the swivel assembly at 10 is a torque mandrel 32. A sub 34, joined to the bottom of the torque mandrel 32, provides a threaded pin 34*a* from which the liner pipe string (not shown) may be suspended.

When the liner string (not shown) has been lowered into the well to the desired depth, the liner hanger at 12 is locked to the casing C by a slip cage shown at 36. The slip cage at 36 includes three lower pipe-gripping slips, or dogs, 38 (only two visible), equally spaced in a circle around the liner hanger mandrel 28. Three identical upper pipe-gripping slips 40 (only one visible) are positioned in a circle above the lower slips 38 so that each upper slip lies on an axial line which passes midway between two adjacent lower slips. Each upper slip 40 is fixed to the end of a link 42 which is connected to an upper support collar 44, a lower support collar 46, and a mounting collar 48. The portion of the link 42 adjacent the upper slip 40 constitutes a spring arm 42*a* urging the slip radially inwardly. The portion of the link 42 between the lower support collar 46 and the mounting collar 48 is bowed radially outwardly to form a drag spring 42*b* which slides along the inner surface of the casing C. Each of the lower slips 38 is connected to a link 50 which is attached to the lower support collar 46 and to the mounting collar 48. The portion of the link 50 adjacent the lower slip 38 forms a spring arm 50*a* urging the lower slip radially inwardly. The portion of the link 50 between the lower support collar 46 and the mounting collar 48 bows radially outwardly to form a drag spring 50*b*.

Three centering guides 52 (only one partially visible) extend inwardly and upwardly from the mounting collar 48, and press inwardly on the outer surface of the liner hanger mandrel 28. A restraining lip 54 prevents the centering guides 52 from riding upwardly along the liner hanger mandrel 28. As the liner hanger at 12 is lowered within the well casing C, friction between the inner surface of the casing and the six drag springs 42*b* and 50*b* inhibits the downward motion of the slip cage at 36, while the restraining lip 54, with the centering guides 52 caught below the lip, forces the slip cage to move down the casing with the liner hanger.

The liner hanger at 12 is locked to the well casing C by a reciprocating motion. When the liner hanger at 12 is raised with respect to the well casing C, the friction between the inner surface of the well casing and the drag springs 42*b* and 50*b* causes the slip cage at 36 to remain stationary with respect to the casing, with the result that the restraining lip 54 is raised above the centering guides 52. A sliding sleeve 56, having a downwardly tapered flange 56*a*, is pulled up under the stationary slip cage at 36 as the liner hanger at 12 is raised. The centering guides 52 ride outwardly over the flange 56*a*. The upward motion of the liner hanger at 12 is then stopped, and the liner hanger is lowered again, with the slip cage at 36 still held fixed to the well casing C by friction. However, the sliding sleeve 56 remains at its upper position, held by the centering guides 52. When the restraining lip 54 forces the sliding sleeve 56 downwardly, the centering guides 52 are spread by the tapered flange 56*a*, and ride over the flange and the restraining lip. The centering guides 52 then ride along the outer surface of liner hanger mandrel 28 above the restraining lip 54, and the slip cage at 36 is free to advance relatively upwardly along the downwardly moving liner hanger mandrel.

Above each lower slip 38, a wedge-shaped lower slip expander 58 is fixed to the liner hanger mandrel 28. An identical upper slip expander 60 is similarly positioned above each of the upper slips 40. As the liner hanger at 12 is not lowered with respect to the stationary slip cage at 36, the slip expanders 60 and 58 are wedged radially inwardly of the slips 40 and 38 respectively, forcing the slips radially outwardly against the inner surface of the well casing C. With the slips 40 and 38 pressed against the inner surface of the well casing C, the horizontal edges on the faces of the slips bind against the well casing, and the array of slips thus locked into position forms a seating assembly in which the liner hanger at 12 sits by way of the slip expanders 60 and 58, and is restrained from further downward movement with respect to the well casing C.

With the liner hanger at 12 locked to the well casing C, torque may be applied at the well surface to the operating string 16 to free the setting tool at 14 from the liner hanger, and to rotate the liner pipe string (not shown). It can be observed in FIGS. 1A and 1B that the entire combination of elements from the connector tube 20 down to the pin 34*a* at the base of the sub 34 is structured generally as two concentric, substantially tubular components. The outer tubular component begins at the upper coupling sleeve 22 and extends down to the sub 34; the inner tubular component begins with the base of the connector tube 20 lying within the upper coupling sleeve 22. A bonnet 62 is fixed by a set screw 64 on the connector tube 20 to form a cap for the annular space between the connector tube and the upper coupling sleeve 22. The bonnet 62 is equipped with a plurality of slots 62*a* to permit fluid pressure equalization above and below the bonnet as the liner pipe string (not shown) is run into the well, and as the setting tool at 14 is withdrawn upwardly from the upper coupling sleeve 22 as described hereinafter.

A setting tool coupling 66 joins the connector tube 20 to a setting tool mandrel 68. The mandrel 68 is rotationally fixed to the coupling 66 by a set screw 70. Such set screws are employed wherever necessary to lock threaded joints which might otherwise separate upon application of torque to the operating string 16 at the well surface for rotation of the liner pipe string (not shown). O-rings 72 and 74 provide fluid seals for the joints of the setting tool coupling 66 with the connector tube 20 and the mandrel 68, respectively.

A running-in nut 76 engages a threaded section 78 of the interior surface of the lower coupling sleeve 24. The nut 76 is rotationally fixed to the mandrel 68 by a plurality of splines 80 (only one visible) fitting into an equal number of appropriate grooves (not shown) lining the inner surface of the nut, but the nut enjoys limited freedom of vertical movement relative to the setting tool mandrel. As the liner pipe string (not shown) is being run into the well, and until the liner hanger at 12 is fixed with respect to the well casing C, the upper edge of a setting tool supporting coupling 82 defines the lower limit of vertical movement of the nut 76 with respect to the mandrel 68. Before the liner hanger at 12 is locked to the casing C, the nut 76 carries the entire weight of the liner pipe string (not shown), with the lower coupling sleeve 24 pulling downwardly on the nut by way of the threads 78, and the mandrel 68 pulling upwardly on the nut by way of the top of the supporting coupling 82.

With the slip cage at 36 holding the liner hanger at 12 in place, torque is applied at the well surface to the operating string 16, causing the operating string, the bonnet 62, the coupling 66, and the mandrel 68 to rotate. The threads 78 of the interior surface of the lower coupling sleeve 24 and the corresponding threads on the nut 76 are left-handed. Consequently, a clockwise rotation of the mandrel 68, as seen from above in FIG. 1A, causes the splines 80 to rotate the nut 76 to advance upwardly along the threads 78. the nut rises clear of the threads 78 in just a few turns of the operating string 16.

A bearing collar 84 is threadedly engaged to the setting tool mandrel 68, and forms the upper race for a plurality of ball bearings 86 (only one visible) which ride on a bearing ring 88 forming a lower race. The bearing ring 88 is constrained by the bearing collar 84 and the ball bearings 86 from above, and an annular shoulder 90 on the interior of the lower coupling sleeve 24 from below. The bearing ring 88 is designed to engage a portion of the inner surface of the lower coupling sleeve 24 as the mandrel 68 is rotated by the operating string 16. The bearing collar 84 then rides the ball bearings 86 in rotational motion with the mandrel 68, while the bearing rings 88 remains stationary with respect to the lower coupling sleeve 24. In this way, the mandrel 68, and all other elements rotationally fixed thereto, are rotated with respect to the lower coupling sleeve 24 and the liner hanger at 12, which is then anchored to the well casing C, to free the nut 76 from the threads 78 and then to apply torque to the liner hanger (not shown).

The supporting coupling 82 is rotationally fixed to the mandrel 68 by a set screw 92, and sealed to the mandrel by an O-ring 94. A swivel unit mandrel 96 is threadedly engaged to the bottom of the support coupling 82, and sealed thereto by an O-ring 98. A swivel unit, shown generally at 100, forms the connection between the swivel unit mandrel 96 and a torque tube 102 which extends downwardly through the interior of the swivel assembly at 10. The swivel unit at 100 permits limited rotation of the swivel unit mandrel 96 with respect to the torque tube 102 to the extent necessary to free the running-in nut 76 from the threads 78 of the lower coupling sleeve 24. Continued rotation of the operating string 16 beyond that points results in the torque applied at the well surface being transmitted to the torque tube 102.

A swivel sleeve 104 is threadedly engaged to the top of the torque tube, rotationally fixed thereto by a set screw 106, and sealed thereto by an O-ring 108. The swivel sleeve 104 extends upwardly around the lower end of the swivel mandrel 96, and is connected to a restraining collar 110. A plurality of set screws 112 (only one visible) in the restraining collar 110 rides on an equal number of ball bearings 114 (only one visible) movable in a suitable groove in the outer surface of the swivel unit mandrel 96 thereby permitting rotation of the mandrel 96 with respect to the restraining collar, but preventing relative vertical motion. An O-ring 116 provides a fluid seal between the swivel sleeve 104 and the swivel unit mandrel 96. A locking nut 118, located in the annular space formed between the swivel sleeve 104 and the swivel unit mandrel 96, engages threads 96*a* on the outer surface of the swivel unit mandrel. A plurality of splines 120 (only one visible) on the inner surface of the swivel sleeve 104 engages an equal number of appropriate grooves (none visible) in the radially outward surface of the locking nut 118, thereby fixing the locking nut rotationally with respect to the swivel sleeve while permitting vertical movement of the locking nut relative to the swivel sleeve.

As the operating string 16 causes clockwise rotation of the setting tool mandrel 68 and the swivel unit mandrel 96, the right-hand-threaded locking nut 118 advances up the threads 96*a* on the surface of the swivel unit mandrel 96 while the running-in nut 76 is moving up the threads 78 of the lower coupling sleeve 24. The inertia of the torque tube 102 and the liner pipe string (not shown) resists rotation of the swivel sleeve 104 as the swivel unit mandrel 96 is rotated as long as the locking nut 118 is free to ride up the threads on the mandrel 96. Eventually the locking nut 118 moves up to the restraining collar 110, and is thereby prevented from moving farther along the swivel unit mandrel 96. At that point, the locking nut 118 is still engaged with the threads on the exterior of the mandrel 96, however, the running-in nut 76 is then above the threads 78, and can ride free of the lower coupling sleeve 24. Continued clockwise rotation of the operating string 16 causes rotation of the swivel sleeve 104, which is then rotationally locked by the nut 118 and the threads 96*a* to the swivel unit mandrel 96 for rotation in the same direction. At that point, the torque tube 102 also rotates with the swivel sleeve 104.

Figure 2:
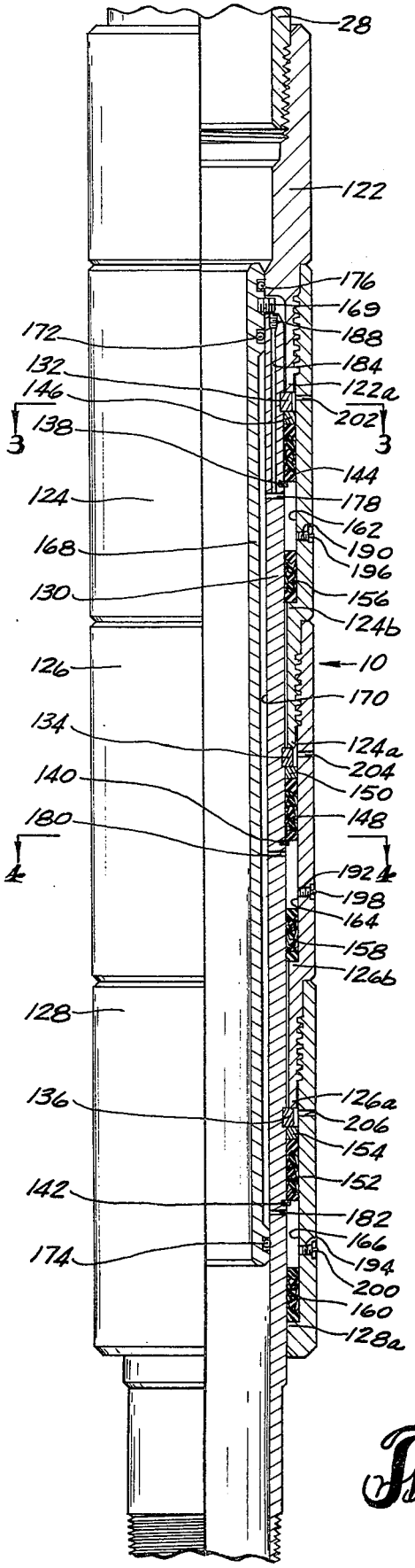
FIG. 2 is a quarter sectional view of the rotary swivel assembly of the present invention.
Figure 3:
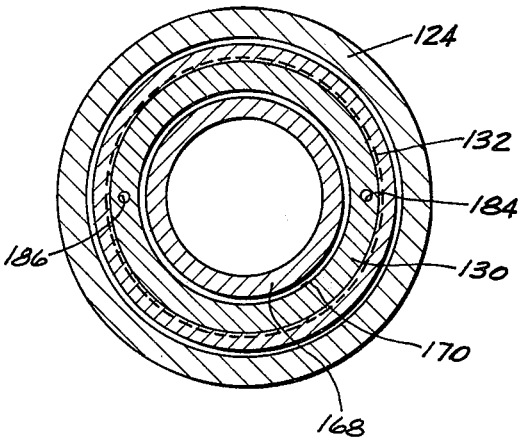
FIG. 3 is an enlarged cross-sectional view taken along line 3—3 of FIG. 2.
Figure 4:
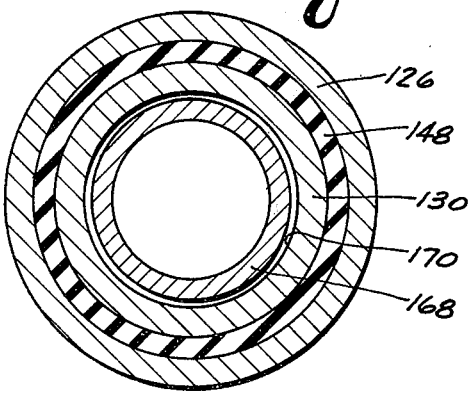
FIG. 4 is an enlarged cross-sectional view taken along line 4—4 of FIG. 2.

FIGS. 2 to 4 provide enlarged views of the rotatable swivel assembly at 10. A swivel housing coupling 122 joins the liner swivel assembly at 10 to the base of the liner hanger mandrel 28. During the running-in process, the sliding sleeve 56 rests on the top of the swivel housing coupling 122. The swivel assembly at 10 is constructed primarily in the form of three concentric cylindrical bodies. The outermost cylindrical body is composed of a series of swivel housing mandrels 124, 126, and 128. The top swivel housing mandrel 124 overlaps the base of the swivel housing coupling 122, and is threadedly engaged therewith, such that the bottom edge of the swivel housing coupling forms a downwardly-facing, annular internal shoulder 122*a*. A similar union exists between the swivel housing mandrels 124 and 126, with a resulting shoulder 124*a*; the union between swivel housing mandrels 126 and 128 forms the shoulder 126*a*. An upwardly-facing, inner annular shoulder 124*b* is formed just above the union between the swivel housing mandrels 124 and 126; a similar shoulder 126*b* is formed just above the union between the swivel housing mandrels 126 and 128. An inner, annular flange 128*a* at the base of the swivel housing mandrel 128 constitutes a similar upwardly-facing shoulder.

The intermediate concentric cylindrical body of the rotatable swivel assembly at 10 is a swivel port mandrel 130. Three load snap rings 132, 134, and 136 are fixed in appropriate grooves in the radially outward surface of the swivel port mandrel 130, located just under the shoulders 122*a*, 124*a*, and 126*a*, respectively. Three packing snap rings 138, 140 and 142 are also fixed in appropriate grooves in the radially outward surface of the swivel port mandrel 130, and located measured distances below the load snap rings 132, 134, and 136, respectively. A packing gland 144 comprising annular rubber rotatable fluid seals, encircles the swivel port mandrel 130 and is axially constrained between the packing snap ring 138 and the load snap ring 132. A bearing ring 146 further separates the packing gland 144 from the load snap ring 132. A similar packing gland 148, and bearing ring 150 are positioned between the packing snap ring 140 and the load snap ring 134; a packing gland 152 and a bearing ring 154 lie between the packing snap ring 142 and the load snap ring 136. Similar packing glands 156, 158 and 160 encircle the swivel port mandrel 130 and rest on the shoulders 124*b* and 126*b*, and the flange 128*a*, respectively. An annular bearing chamber 162 is thus formed between the swivel port mandrel 130, the swivel housing mandrel 124, and the packing glands 144 and 156; a similar bearing chamber 164 is formed between the swivel port mandrel 130, the swivel housing mandrel 126, and the packing glands 148 and 158; a bearing chamber 166 is also formed between the swivel port mandrel 130, the swivel housing mandrel 128, and the packing glands 152 and 160.

The innermost concentric cylindrical body of the rotatable swivel assembly at 10 is a swivel core mandrel 168. The swivel core mandrel 168 is supported by a plurality of set screws 169 (only one visible) protruding from appropriate threaded holes in the swivel core mandrel, and resting on the top of the swivel port mandrel 130. The outer diameter of the swivel core mandrel 168 increases at both ends producing an elongate, annular fluid communication chamber 170 between the swivel core mandrel 168 and the swivel port mandrel 130. The fluid communication chamber 170 is sealed by O-rings 172 and 174 set in appropriate grooves near the top and bottom of the swivel core mandrel 168 respectively. The swivel core mandrel 168 is also sealed to the swivel housing coupling 122 by an O-ring 176.

A plurality of ports 178 (only one visible) in the swivel port mandrel 130 allow free fluid flow between the bearing chamber 162 and the communication chamber 170. Similar arrangements of ports 180 and 182 connect the communication chamber 170 to the bearing chambers 164 and 166 respectively. The bearing chambers 162, 164, and 166, the ports 178, 180 and 182, and the communication chamber 170 are filled with a fluid such as oil or mercury.

Two bores 184 and 186 extend down within the swivel port mandrel 130 from the top to two of the ports 178 to provide a means for inserting the fluid before the swivel housing coupling 122 is joined to the top swivel housing member 124. Plugs 188 (only one visible) then close the bores 184 and 186. Alternatively, the fluid may be inserted into the system through threaded ports 190, 192 and 194 in the swivel housing mandrels 124, 126 and 128 respectively, leading directly to the bearing chambers 162, 164 and 166 respectively. The threaded ports 190, 192 and 194 are plugged with Zert fittings 196, 198 and 200 respectively. Breathing ports 202, 204, and 206 are provided through the swivel housing members 124, 126 and 128 respectively in the vicinity of the load snap rings 132, 134 and 136 respectively to prevent pressure increases in those areas during the insertion of the fluid or during the use of the swivel assembly at 10 in a liner placement operation in a well.

As best seen in FIG. 1B, the swivel port mandrel 130 extends downwardly beyond the swivel core mandrel 168 and the lowest swivel housing mandrel 128, and is threadedly joined to the torque mandrel 32 by the coupling 30. The torque tube 102 extends downwardly within the torque mandrel 32, wherein a torque-transmitting cam-operated dog assembly, shown generally at 208, is constructed on the torque tube. Two cam dogs 210 (only one visible) are constrained by an upper flange ring 212 and a lower flange ring 214, which in turn are held against axial motion relative to the torque tube 102 by an upper snap ring 216 and a lower snap ring 218 respectively. A camming surface 220 extends outwardly from the torque tube 102 behind each cam dog 210 (only one visible). With no rotational motion imparted to the torque tube 102, the cam dogs 210 are held relatively loosely in place by the flange rings 212 and 214. When the torque tube 102 is rotated, ultimately by torque applied to the operating string 16 at the well surface, friction between the cam dogs 210 and the interior surface of the torque mandrel 32 provides sufficient drag on the cam dogs to cause them to lag behind the rotation of the torque tube. The camming surfaces 220 (only one visible) are then rotated relative to the cam dogs 210. The camming surfaces 220 are so contoured that the rotational displacement of the camming surfaces with respect to the cam dogs 210 (only one visible) causes the camming surfaces to force their respective cam dogs radially outwardly against the interior surface of the torque mandrel 32, thereby providing a lock between the rotating torque tube 102 and the torque mandrel. The result is that the torque mandrel 32 rotates with the torque tube 102. When the rotation of the torque tube 102 ceases, the camming surfaces 220 no longer force the cam dogs 210 against the torque mandrel 32, and the torque tube and the torque mandrel are no longer locked together. Such camming operations are well known in the art.

The torque mandrel 32 is threadedly engaged to the sub 34, to which is attached the liner pipe string (not shown) to be placed in the well. A cementing tube 222 is suspended below the torque tube 102 by a collar 224 with O-ring seals 226 and 228, and rotates with the torque tube. The bottom of the cementing tube 222 extends below the pin 34*a* of the sub 34, and is therefore within the first segment of the liner (not shown) when the latter is attached to the sub. A packing gland 230 is held against the cementing tube 222 by a frame 232 that is threadedly engaged to the inner surface of the sub 34, and forms a fluid rotational seal to prevent cement from moving up the annular space between the cementing tube and the sub. Snap rings 234 and 236, in appropriate grooves in the interior surface of the sub 34, prevent the frame 232 from moving relative to the sub as the cementing tube 222 is rotated prior to the locking of the torque mandrel 32 to the torque tube 102 by the cam dog assembly at 208 as described hereinbefore. An O-ring seal 238 provides a fluid seal between the frame 232 and the sub 34.

When the liner pipe string (not shown) has been lowered in the well to the desired position, the reciprocating motion as described hereinbefore is effected to lock the liner pipe hanger at 12 to the well casing C by means of the slip cage assembly at 36. Clockwise torque is then applied at the surface to the operating string 16 to free the running-in nut 76 from the threads 78 of the lower coupling sleeve 24, while the swivel unit at 100 permits the setting tool mandrel 68 and the swivel unit mandrel 96 to rotate while the torque tube 102 remains stationary. With the running-in nut free of the threads 78 of the lower coupling sleeve 24, continued application of torque to the operating string 16 causes the locking nut 118 to be forced against the restraining collar 110, thereby transmitting the torque from the swivel unit mandrel 96 to the torque tube 102. At this point, the entire weight of the liner pipe string (not shown) is supported by the rotatable swivel assembly at 10, the liner hanger mandrel 28, and the slip cage at 36, rather than by the operating string 16. The rotation of the torque tube 102 causes the cam-operated dog assembly at 208 to lock the torque tube rotationally to the torque mandrel 32. The torque mandrel 32 then rotates with the torque tube 102 in response to continued application of torque on the operating string 16 at the well surface. Rotation of the torque mandrel 32 causes rotation of the sub 34 and of the liner pipe string (not shown) attached thereto.

Cement may be introduced into the interior of the operating string 16 at the surface, and will fall through the setting tool mandrel 68, the swivel unit mandrel 96, the torque tube 102, and the cementing tube 222 into the interior of the liner pipe string (not shown). As the liner pipe string (not shown) fills with cement, the cement may be forceably driven down through the bottom of the liner pipe string into the annular region between the liner pipe string and the well casing C in a manner well known in the art. It will be appreciated that the various O-ring seals described hereinbefore in the couplings that occur from the connector tube 20 down as well as the packing gland 230 prevent the cement from moving into the various annular spaces between the innermost elements and the exterior portions of the setting the tool at 14, the liner hanger at 12, and the rotatable swivel assembly at 10, as well as the annular regions between the torque tube 102 and the cementing tube 222, and the torque mandrel 32 and the sub 34.

Until the liner pipe string (not shown) is made to rest on the bottom of the well, or until the cement is set to hold the liner pipe string in place, the weight of the liner pipe string is carried through the swivel port mandrel 130 to the three load snap rings 132, 134, and 136. Even with the liner pipe string resting on the well bottom, part of the liner weight is carried in this manner, particularly in the case of a long liner pipe string. The downward force exerted by the swivel port mandrel 130 on the top load snap ring 132 is transmitted by that load snap ring to the bearing ring 146 and the packing gland 144. The packing gland 156 rests on the shoulder **124*a* of the upper swivel housing mandrel 124, and is therefore constrained against downward movement with respect to the upper swivel housing mandrel. The swivel housing mandrels 124, 126, and 128, supported from above, exert upward forces on the packing glands 156, 158, and 160. Consequently, with the downward load force exerted on the packing gland 144 and the upward support force exerted on the packing gland 156, the bearing fluid in the bearing chamber 162 tends to be compressed between these two packing glands. Similarly, the bearing fluid in the bearing chamber 164 tends to be compressed by the packing glands 148 and 158, and the bearing fluid in the bearing chamber 166 tends to be compressed between the packing glands 152 and 160. A change in the pressure in the bearing fluid in any one of the three bearing chambers 162, 164, and 166 is transmitted through the ports 178, 180, and 182 and the fluid communication chamber 170. Consequently, the fluid pressure in the three bearing chambers 162, 164, and 166** is uniform virtually all of the time, ensuring that the load of the liner pipe string is evenly distributed among all the bearing chambers.

With the exception of the sealing contacts of the O-ring 176 and the packing glands 144, 156, 148, 158, 152, and 160, there is only fluid contact between the outer elements of the rotatable swivel assembly at 10, including the three swivel housing mandrels 124, 126, and 128 and the swivel housing coupling 122, and the interior, or core, elements of the rotatable swivel assembly, including the swivel core mandrel 168, and the swivel port mandrel 130. Therefore, the aforementioned interior elements of the rotatable swivel assembly at 10 may be rotated with respect to the outer elements of the rotatable swivel assembly, with the aforementioned O-ring and packing glands providing rotatable fluid seals therebetween. In this manner, the bearing fluid in the bearing chambers 162, 164, and 166 provides rotational bearing support as well as the load bearing support as hereinbefore described.

It will be appreciated that the essential features of the present invention, particularly the load bearing and rotational bearing characteristics of the bearing fluid system, including the fluid pressure communication mechanism provided by the communication chamber 170 and the ports 178, 180 and 182, may be effected by modifications of the embodiment of the rotatable swivel assembly shown at 10. In particular, the fluid pressure communication mechanism linking the bearing chambers 162, 164, and 166 may be constructed in the outer portion of the rotatable swivel assembly. Also, the swivel assembly may be constructed so that the liner pipe string is attached to the outer portion of the swivel assembly, and the inner portion of the swivel assembly is suspended from the liner hanger at 12. In that case, the inner elements of the swivel assembly are locked against rotation with the liner hanger, and the outer portion of the swivel assembly is rotatable with the torque mandrel 32. Such an arrangement may be effected, for example, by inverting the swivel assembly shown at 10 in FIGS. 1B and 2, and providing suitable coupling devices between the swivel port mandrel 130 and the liner hanger mandrel 28, as well as between the combination of swivel housing mandrels 124, 126, and 128 and the liner pipe string (not shown). In any event, the fluid pressure communication mechanism may be constructed either in the interior portion of the rotatable swivel assembly, or in the outer portion of the rotatable swivel assembly.

The swivel assembly of the present invention may find general application wherever thrust and/or rotational bearing devices are necessary or advantageous. The present invention is particularly suitable for application to manipulation of well equipment, for example, as detailed hereinbefore, where the invention produces new and unusual results.

The foregoing disclosure and description of the invention is illustrative and explanatory thereof, and various changes in the size, shape and materials as well as in the details of the illustrated construction may be made within the scope of the appended claims without departing from the spirit of the invention.

We claim:

1. A swivel device comprising:

a. generally tubular housing means;

b. core means rotatably carried within said housing means;

c. fluid seal means between said housing means and said core means, defining a plurality of fluid chamber means between said housing means and said core means;

d. fluid pressure communicating passage means interconnecting each of said fluid chamber means;

e. bearing fluid means contained within said fluid chamber means and said fluid pressure communicating passage means to function as load bearing means and as rotational bearing means between said housing means and said core means; and f. said fluid chamber means arrayed such that load, supported by said bearing fluid means in said fluid chamber means as load bearing means, is generally equally distributed among said fluid chamber means.

2. A swivel device as defined in claim 1 wherein said core means includes a through passage for permitting fluids to be conducted through said swivel device.

3. A swivel device as defined in claim 1 wherein at least one of said fluid seal means is movable longitudinally with said core means relative to said housing means.

4. A swivel device as defined in claim 1 wherein said fluid pressure communicating passage means includes an annular passage.

5. A swivel device as defined in claim 4 wherein said housing means and said core means are substantially concentric.

6. A swivel device as defined in claim 5 wherein said fluid chamber means comprise annular chamber means.

7. A swivel device as defined in claim 4 wherein said core means includes concentric tubular bodies and said fluid pressure communicating passage means is located between said concentric tubular bodies.

8. A swivel device as defined in claim 7 wherein said fluid chamber means comprise annular chamber means.

9. A swivel device as defined in claim 1 wherein said housing means and said core means are substantially concentric.

10. A swivel device as defined in claim 1 further including anchoring means for connecting said swivel device to a surrounding conduit.

11. A rotary swivel device for use with a hanger device to be locked in a well for operations involving rotation of equipment carried by said rotary swivel device comprising:

a. first body means supportable by said hanger device;

b. second body means rotatable with respect to said first body means;

c. fluid seal means defining more than one fluid bearing chamber means between said first body means and said second body means;

d. conduit means for communicating fluid pressure among said fluid bearing chamber means;

e. bearing fluid means in said fluid bearing chamber means for load bearing and for rotational motion bearing between said first body means and said second body means; and f. said fluid bearing chamber means arrayed such that load, supported by said bearing fluid means in said fluid bearing chamber means, is generally equally distributed among said fluid bearing chamber means.

12. A rotary swivel device as defined in claim 11 wherein:

a. said first body means comprises substantially tubular housing means; and b. said second body means comprises core means generally within said housing means.

13. A rotary swivel device as defined in claim 12 wherein said conduit means is included within said core means.

14. A rotary swivel device as defined in claim 12 wherein said core means and housing means are substantially concentric.

15. A rotary swivel device as defined in claim 14 wherein said core means includes concentric tubular bodies and said conduit means is located between said concentric tubular bodies.

16. A rotary swivel device as defined in claim 12 wherein said conduit means comprises:

a. elongate passage means included within one of said first or second body means; and b. port means extending from said elongate passage means for communicating fluid pressure between said elongate passage means and each of said bearing chamber means.

17. A rotary swivel device as defined in claim 16 wherein said elongate passage means comprises elongate annular path means.

18. A rotary swivel device as defined in claim 11 wherein:

a. said second body means comprises substantially tubular housing means; and b. said first body means comprises core means generally within said housing means.

19. A rotary swivel device as defined in claim 18 wherein said core means includes concentric tubular bodies and said conduit means is located between said concentric tubular bodies.

20. A rotary swivel device as defined in claim 11 further comprising:

a. connection means for linking said hanger device to running-in means for lowering said hanger device and said rotary swivel device down said well; and b. torque transfer means for transmitting torque from said running-in means to said equipment.

21. A rotary swivel device as defined in claim 20 wherein said connection means includes detachment means for detaching said running-in means from said hanger device by rotation of said running-in means with respect to said hanger device, and further including selectively operable transfer means for detaching said running-in means without transmitting torque from said running-in means to said torque transfer means.

22. A rotary swivel device as defined in claim 11 further including:

a. running-in means for positioning said rotary swivel device and said hanger device within said well and for imparting torque to a torque transfer means for transmitting torque from said running-in means to said second body means to effect rotation of said second body means with respect to said first body means;

b. setting means for supporting, and for connecting said running-in means with, said hanger device during said positioning within said well;

c. locking means included in said hanger device for locking said hanger device within said well against further downward movement in said well; and d. release means for selectively releasing said setting means relative to said hanger device when said hanger device is locked whereby torque from said running-in means may be imparted to said torque transfer means to rotate said equipment when said running-in means is rotated.

23. A rotary swivel device as defined in claim 22 wherein said locking means comprises slip means.

24. A rotary swivel device as defined in claim 22 wherein said release means comprises first and second threadedly engaged assemblies, said first assembly being operable by initial rotation of said running-in means for releasing said setting means from said hanger device while said equipment remains rotatably stationary, and said second assembly being operable by subsequent rotation of said running means for imparting rotary motion to said equipment.

25. A method of manipulating equipment within a well comprising the steps of:

a. supporting said equipment within said well by fluid bearing swivel means supported by a hanger device suspended from running-in means;

b. anchoring said hanger device against further downward movement in said well;

c. removing weight of said equipment and said fluid bearing swivel means from said running-in means by releasing said running-in means from said hanger device; and d. rotating said equipment relative to said hanger device while introducing cement into the region between said equipment and said well.

26. A method of manipulating equipment as defined in claim 25 wherein said running-in means is released from said hanger device by rotating said running-in means relative to said anchored hanger device while said equipment remains substantially stationary, and said equipment is rotated by torque imparted to said equipment by subsequent continued rotation of said running-in means after said running-in means is released.

27. A method of manipulating equipment as defined in claim 25 wherein said equipment comprises an elongate well liner and said cement is introduced by passing said cement down said running-in means, through said liner and into said region between said liner and said well while said liner is being rotated relative to said hanger device.

* * * * *

UNITED STATES PATENT AND TRADEMARK OFFICE

CERTIFICATE OF CORRECTION

PATENT NO. : 4030546

DATED : June 21, 1977

INVENTOR(S) : Jerry L. Rogers and Chudleigh B. Cochran

It is certified that error appears in the above-identified patent and that said Letters Patent are hereby corrected as shown below:

In Column 4, line 38, delete the word "not" and insert therefor --now--.

In Column 5, line 56, delete the word "rings" and insert therefor --ring--.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*